US009284151B2

(12) United States Patent
Wind et al.

(10) Patent No.: US 9,284,151 B2
(45) Date of Patent: Mar. 15, 2016

(54) OUTPUT ASSEMBLY FOR RECEIVING A SHEET OUTPUT BY A PRINTING DEVICE

(71) Applicant: OCE-TECHNOLOGIES B.V., Venlo (NL)

(72) Inventors: Anne A. Wind, Eindhoven (NL); Lamberdina J. A. M. Driessen-Olde Scheper, Venlo (NL); Maurice J. C. Lemmens, Sint-Odilienberg (NL); Ronnie E. A. Blom, Linne (NL); Leonardus R. A. Willems, Swalmen (NL); Antonius J. J. Van De Pasch, Beringe (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/511,736

(22) Filed: Oct. 10, 2014

(65) Prior Publication Data

US 2015/0042039 A1 Feb. 12, 2015

Related U.S. Application Data

(63) Continuation of application No. PCT/EP2013/057549, filed on Apr. 11, 2013.

(30) Foreign Application Priority Data

Apr. 27, 2012 (EP) ..... 12165899

(51) Int. Cl.

| | |
|---|---|
| ***B65H 29/34*** | (2006.01) |
| ***B65H 31/24*** | (2006.01) |
| ***B65H 29/46*** | (2006.01) |

(Continued)

(52) U.S. Cl.

CPC ..... *B65H 31/24* (2013.01); *B65H 29/46* (2013.01); *B65H 29/52* (2013.01); *B65H 29/58* (2013.01); *B65H 31/02* (2013.01); *B65H 31/26* (2013.01); *B65H 43/00* (2013.01); *B65H 2404/61* (2013.01); *B65H 2404/691* (2013.01); *B65H 2404/693* (2013.01); *B65H 2601/251* (2013.01); *B65H 2701/11312* (2013.01); *B65H 2801/12* (2013.01)

(58) Field of Classification Search

CPC ..... B65H 29/34; B65H 29/36; B65H 29/46; B65H 31/22; B65H 31/24; B65H 2404/691; B65H 2404/692; B65H 2404/693; B65H 2404/61

See application file for complete search history.

(56) References Cited

U.S. PATENT DOCUMENTS

| | | | | |
|---|---|---|---|---|
| 5,407,192 A | | 4/1995 | Ueda et al. | |
| 6,012,862 A | * | 1/2000 | Nakano et al. | 400/625 |
| 6,099,452 A | * | 8/2000 | Hoza et al. | 493/416 |

FOREIGN PATENT DOCUMENTS

JP 1-167161 A 6/1989

*Primary Examiner* — Michael McCullough

(74) *Attorney, Agent, or Firm* — Birch, Stewart, Kolasch & Birch, LLP

(57) ABSTRACT

In order to enable simple and easy handling of a large number of large format sheets, an output assembly is provided. The output assembly comprises a lower output tray element for receiving the sheets. In order to reliably transport and deposit a large format sheet from the printing device onto the lower output tray element, a guide element is provided just below an output opening of the printing device such to guide a leading edge of the sheet onto the lower output tray element. Once the leading edge is supported by the lower output tray element, the guide element is retracted such to enable a trailing edge to be deposited on the lower output tray element.

7 Claims, 3 Drawing Sheets

(51) Int. Cl.

| | | | |
|---|---|---|---|
| ***B65H 29/52*** | (2006.01) | ***B65H 29/58*** | (2006.01) |
| ***B65H 31/02*** | (2006.01) | ***B65H 31/26*** | (2006.01) |
| | | ***B65H 43/00*** | (2006.01) |

OUTPUT ASSEMBLY FOR RECEIVING A SHEET OUTPUT BY A PRINTING DEVICE

CROSS REFERENCE TO RELATED APPLICATIONS

This application is a Continuation of PCT International Application No. PCT/EP2013/057549, filed on Apr. 11, 2013, which claims priority under 35 U.S.C. 119(a) to patent application Ser. No. 12/165,899.1, filed in Europe on Apr. 27, 2012, all of which are hereby expressly incorporated by reference into the present application.

FIELD OF THE INVENTION

The present invention generally pertains to an output assembly for receiving a sheet of a recording medium from an output opening of a printing device and pertains to a method for depositing a sheet in an output tray.

BACKGROUND ART

It is known from the prior art to print a sheet using a printing device and depositing such sheet in or on a tray, thus collating a number of sheets to form a pile of printed sheets out put by the printing device. Such output trays are in particular known and common in combination with small format sheets. Herein, a sheet is considered to be a small format sheet if the sheet is not larger than about an A3 format (about 42 cm in length and about 30 cm in width).

In large format (larger than A3 format) printing, in view of the relatively low speed and/or low number of prints, such piling of printed sheets has been limited. Moreover, in case a large number of sheets was printed, such printing was performed on a web that was fed from a roll and was then output onto a roll. Hence, no large piles of large format sheets were generated.

Printing large format sheets at a relatively high speed and thereby generating a pile of large format sheets, has a disadvantage that such pile is very difficult to be handled due to a combination of size and weight. Hence, it would be cumbersome to have to remove such pile after every small number of sheets or to have to remove such heavy and large pile. However, in view of productivity, it is preferred to be able to have the printing device to continue printing without requiring any intervention of an operator. So, generating a pile of printed large format sheets without an operator having to intervene during printing results in a heavy pile that is difficult to handle and while handling such heavy pile, the printing device may not be enabled to continue printing, again limiting the productivity of the printing device.

In small format sheet processing, it is known to use a guide element that supports a sheet being output until the sheet is completely output, thus supporting the whole sheet, and then retracting the guide element while preventing the sheet from being retracted with the guide element. Such arrangement is known, for example, from JP1167161A. In large format printing, the use of such a guide element is not feasible, as the guide element would need to be unfeasibly large for supporting.

SUMMARY OF THE INVENTION

It is an object of the present invention to provide an out put assembly for receiving a number of large format sheets, while not limiting the productivity of the printing device.

The object is achieved by the output assembly according to claim 1 and the corresponding method according to claim 7.

The output assembly comprises a stand-alone output tray element, i.e. a tray element that is independently supported and moveable relative to the printing device. Thus, sheets output by the printing device are deposited on the output tray element and once the pile has been formed, the output tray element including the pile may be moved away from the printing device. At a desired location away from the printing device, the pile of sheets may be further processed.

Further, another, similar output tray element may be arranged near the output opening of the printing device such to receive output sheets, thereby enabling the printing device to continue printing, while an operator processes the printed sheets received on the first output tray element.

In order to reliably and correctly deposit the output sheets on the output tray element, a guide element—or multiple guide elements—is employed to guide a leading edge of each sheet onto the output tray element or the pile of sheets arranged on the output tray element. Once the leading edge has been guided onto the output tray element, the guide element is retracted in order to enable a trailing edge to be deposited. Thereto, the guide element has a length in an output direction, i.e. a direction of movement of the sheet when being output through the output opening, which length is small compared to a length of the output tray element (in the output direction). The length of the guide element needs to be sufficient to guide the leading edge of an output sheet to the output tray element and depositing such leading edge onto the output tray element such that the sheet will slide over the output tray element (or sheets previously deposited on the output tray element) without further guidance, allowing the guide element to be retracted enabling the trailing edge to be deposited.

In an embodiment, the guide element is flexible, i.e. having a suitable flexibility. Its flexibility may be selected such that the guide element is suitable for bending and guiding a leading edge of a sheet towards an output tray element arranged lower than the output opening thereby bridging a height difference irrespective of whether the height difference is relatively large due to the absence of any sheets or the height difference is relatively small due to the presence of a pile of sheets.

In an embodiment of the output assembly, the output sheet has been cut from a roll-fed web of the recording medium and the output tray further comprises an upper tray element arranged over the lower tray element. If the sheet has been input in the printing device from a roll and is cut into a sheet by the printing device, the leading edge and the trailing edge tend to curl, in particular if the printing device does not apply heat to the recording medium such as in case the printing device employs an inkjet printing process. Such curl of the leading edge results in a tendency of the sheet to flip over its leading edge, unless curling of the leading edge is prevented. An upper tray element arranged at a suitable distance from the lower tray element limits the possibility for the sheet to rise and hence to curl, thereby preventing the sheet to flip over its own leading edge.

In an embodiment of the output assembly, the lower tray element is slidably supported on the support surface. Such embodiment provides for a simple and easy way for removing the lower tray element once the pile of output sheets has been formed.

In an embodiment of the output assembly, the printing device is coupled to a sensing unit for determining whether the lower tray is suitably arranged near the output opening for receiving the sheet. A sensing of the availability of the lower output tray may prevent that sheets are output without the lower output tray being suitably arranged for receiving the output sheet. In particular, the printing device may be configured not to output the sheet, if the lower tray is not suitably arranged for receiving the sheet.

In another particular embodiment of such output assembly having a sensing unit, the printing device comprises a first output opening and a second output opening, the output assembly comprises a first output tray having a first lower tray element and a second output tray having a second lower tray element and the printing device is coupled to a first sensing unit for determining whether the first lower tray is suitably arranged near the first output opening and is coupled to a second sensing unit for determining whether the second lower tray is suitably arranged near the second output opening. In such embodiment, the printing device may be configured to select one of the first output opening and the second output opening based on the determination whether the first and the second lower output tray elements are suitably arranged for receiving the output sheet. For example, the printing device may first attempt to output any sheet through the first output opening, but if the first lower output tray element is not suitably arranged, the printing device may select the second output opening for outputting the sheets, provided that the second lower output tray is suitably arranged. Of course, the person skilled in the art readily understands that any scheme of conditions may be selected in accordance with any requirements or desires of an operator. In any case, this embodiment enables to remove the first lower output tray element, for example when the tray has been filled, without limiting the productivity, since the printing device may continue printing and depositing in the second tray.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF THE DRAWINGS

Figure 1:
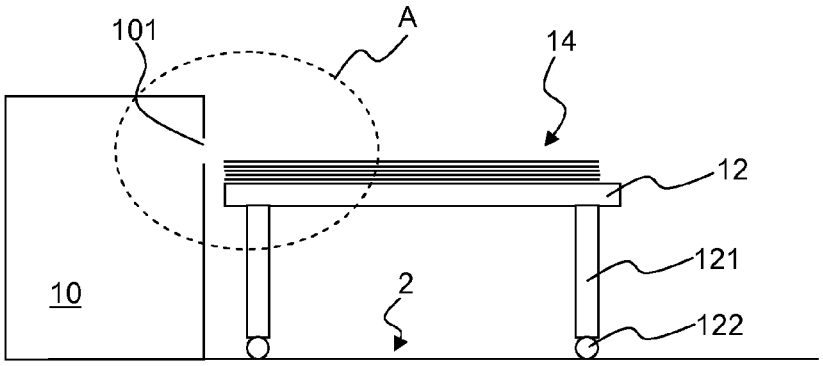
FIG. 1 schematically illustrates a printing device and an output assembly according to the present invention.

The present invention will now be described with reference to the accompanying drawings, wherein the same reference numerals have been used to identify the same or similar elements throughout the several views.

FIG. 1 shows a printing device 10 having an output opening 101 and an output assembly according to the present invention comprising a lower output tray element 12 having stacked thereon a pile of sheets 14. The printing device 10 and the lower output tray element 12 are each, independently supported on a support surface 2. The lower output tray element 12 is provided with wheels 122 on support elements 121 such that the lower output tray element 12 is easily moveable over the support surface 2.

The area A indicated in FIG. 1 is illustrated in FIGS. 2A-2C and FIGS. 3A-3E in more detail for elucidating the present invention.

Figure 2A:
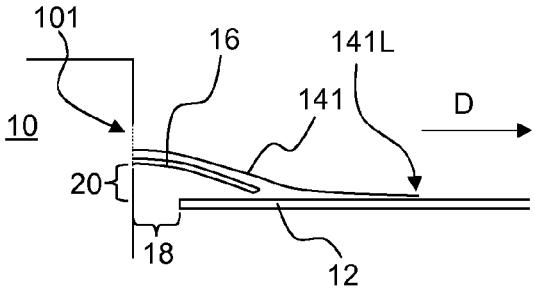
FIG. 2A-2D schematically illustrate a sheet being output by the printing device onto a lower tray element according to the present invention.
Figure 2B:
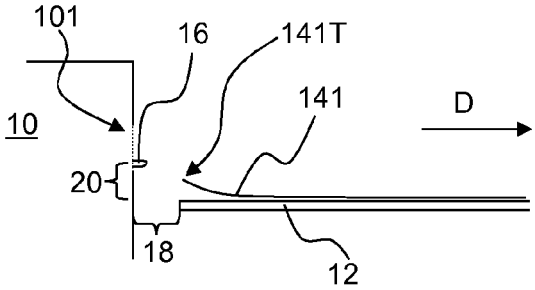
Figure 2C:
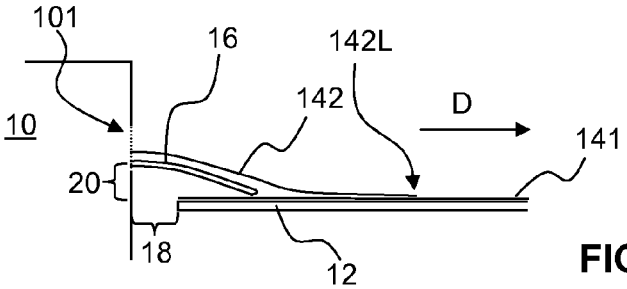

Referring to FIGS. 2A-2C, the method and assembly according to the present invention are elucidated. In FIG. 2A the printing device 10 and the lower output tray element 12 are shown. A first sheet 141 is output from the output opening 141 onto the lower output tray element 12, thereby moving in an output direction D, i.e. a direction of movement of the sheet when being output through the output opening.

A guide element 16 is arranged below the output opening 101 and is in an extended state.

A leading edge 141L of the first sheet 141 has been guided over the guide element 16 onto the lower output tray element 12. The guide element 16 has ensured that a gap 18 and/or a height difference 20 between the output opening 101 and the lower output tray element 12 is bridged such that the leading edge 141L reliably arrives at the lower output tray element 12.

FIG. 2B shows the guide element 16 in a retracted state. The first sheet 141 has been output from the output opening 101 completely and a trailing edge 141T of the first sheet 141 is enabled to be deposited on the lower output tray element 12 due to the retracted state of the guide element 16.

FIG. 2C illustrates a second sheet 142 being output from the output opening 101. Thereto, the guide element 16 has been controlled to move in the direction D to its extended state, allowing a leading edge 142L of the second sheet 142 to reliably arrive at the lower output tray element 12 to be deposited on the first sheet 141.

Figure 2D:
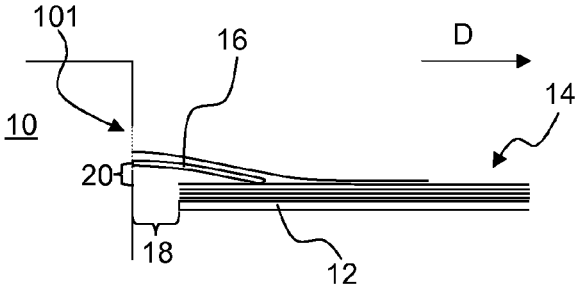

In a preferable embodiment, the guide element 16 has a suitable flexibility. Its flexibility may be selected such that (I) the guide element 16 is suitable for guiding a leading edge of a sheet and (II) the guide element 16 may suitably bend towards the lower output tray element for bridging any height difference 20 irrespective of whether the height difference 20 is relatively large due to the absence of any sheets or the height difference 20 is relatively small due to the presence of a pile of sheets as shown in FIG. 2D.

Figure 3A:
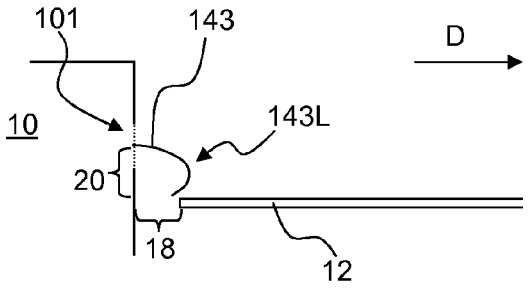
FIG. 3A-3E schematically illustrate a sheet having a curled leading edge being output by the printing device onto a lower tray element.

FIG. 3A illustrates a third sheet 143 being output from the output opening 101 of the printing device 10. The third sheet 143 has a curled leading edge 143L. Such curled leading edge 143L may be resulting from the recording medium being provided as a web on a roll. The printing device 10 has been supplied with the recording medium as such web and has cut the web suitably corresponding to a printed image, for example, thereby providing for the third sheet 143. In particular if the recording medium is not heated in the printing device 10, the third sheet 143 tends to maintain the shape it had on the roll, i.e. curled. The leading edge 143L and a trailing edge 143T (FIG. 3D) have as a result a tendency to curl.

As illustrated in FIG. 3A, in absence of a guide element 16 according to the present invention, the leading edge 143L curls such that the third sheet 143 flips over its own leading edge 143L due to the gap 18 and the height difference 20. As a consequence, the delivery of sheets onto the lower output tray element 12 would not be reliable.

Figure 3B:
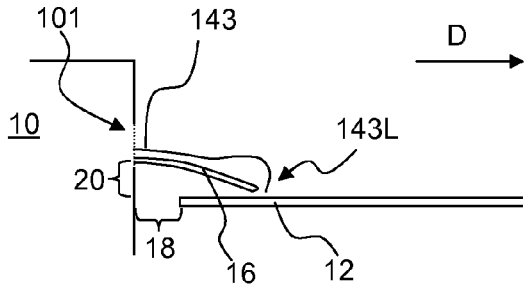

FIG. 3B shows a situation in which the guide element 16 is provided and is in an extended state. Due to the curl of the leading edge 143L, a bow occurs directly after the leading edge 143L (as considered in the direction D in which the third sheet 143 is moving). Once the leading edge 143L comes into contact with the lower output tray element 12, the leading edge 143L experiences an increased friction and the bow may increase even to the extent that the third sheet 143 may flip over its leading edge 143L.

Figure 3C:
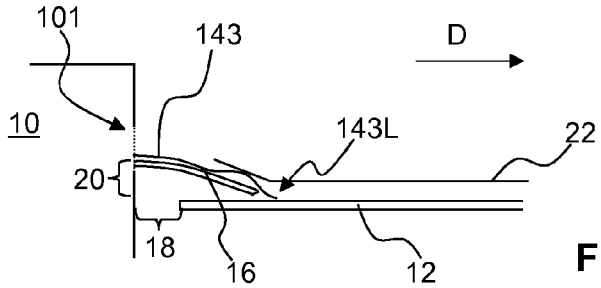

To increase the reliability of stacking the sheets on the lower output tray element 12, an upper output tray element 22 may be provided as shown in FIG. 3C. The upper output tray element 22 is arranged at a predetermined distance above the lower output tray element 12. The predetermined distance is selected such that the bow (FIG. 3B) cannot increase to such extent that the third sheet 143 may flip over its leading edge 143L. Thus, the curled leading edge 143L is guided from the output opening 101 over the guide element 16 under the upper output tray element 22 and then onto the lower output tray element 12. Once the leading edge 143L is arranged between the lower and the upper output tray elements 12, 22, the guide element 16 may be retracted into its retracted state.

Figure 3D:
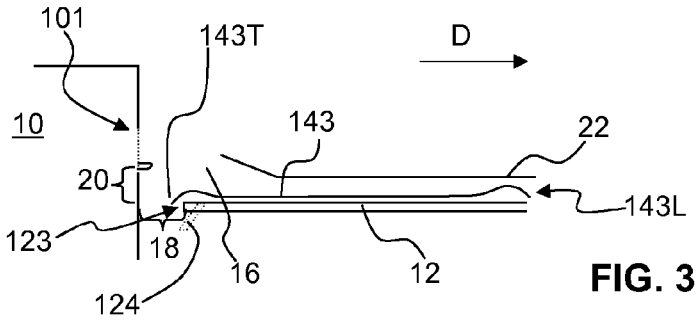

In such retracted state, the third sheet 143 may be deposited onto the lower output tray element 12 as shown in FIG. 3D. Due to the curl in the third sheet 143, the trailing edge 143T has a tendency to curl, thereby generating a bow near the trailing edge 143T. With an increasing number of sheets on the lower output tray element 12, the bow may become too high, resulting in blocking the output opening 101. To increase reliability of the output assembly, the lower output tray element 12 may be arranged such to provide a relatively large gap 18, thereby resulting in the trailing edge 143T of the third sheet 143 hanging over a tray edge 123 of the lower output tray element 12. As a consequence, the bow will be relatively small. In another embodiment, the lower output tray element 12 may be provided with a downwardly slanted tray edge strip 124 (illustrated in dotted lines in FIG. 3D) for allowing the trailing edge 143T to hang downwardly thereby preventing the bow near the trailing edge 143T to become too high.

Figure 3E:
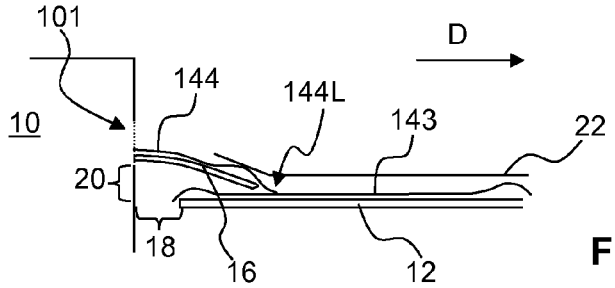

FIG. 3E then illustrates how a fourth sheet 144 may be deposited on the third sheet 143.

Figure 4A:
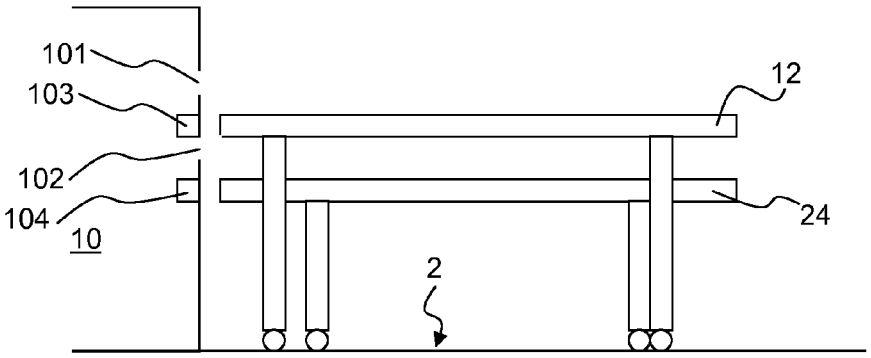
FIG. 4A-4B schematically illustrate further embodiments of an output assembly according to the present invention.

FIG. 4A illustrates an embodiment in which the output assembly comprises a first lower output tray element 12 and a second lower output tray element 24. The printing device 10 is provided with a first output opening 101 and a second output opening 102. The first output opening 101 is arranged such to be enabled to deposit sheets onto the first lower output tray element 12 and the second output opening 102 is arranged to deposit sheets onto the second lower output tray element 24.

The printing device 10 is further provided with a first sensing unit 103 and a second sensing unit 104. Each sensing unit 103, 104 is configured to determine whether the first power output tray element 12 and the second lower output tray element 24, respectively, are arranged for receiving sheets from the respective output openings 101, 102. Note that the sensing units 103, 104 may be arranged on the lower output tray elements 12, 24, respectively, or may have any other suitable configuration, as apparent to a person skilled in the art. In any case, suitable sensing units are well known in the art and their embodiments are therefore not elucidated in further detail herein.

In this embodiment, the printing device 10 may be configured to output sheets through the first output opening 101 to deposit sheets onto the first lower output tray element 12. Prior to outputting through the first output opening 101, the printing device 10 may verify the presence of the first lower output tray element 12 using the first sensing unit 103. Upon detection of the first lower output tray element 12, the sheet may be deposited on the first lower output tray element 12.

Upon detection of the absence of the first lower output tray element 12, the printing device 10 may verify the presence of the second lower output tray element 24 for depositing the sheet. Upon detection of the presence, the sheet may be output through the second output opening 102 for depositing the sheet on the second lower output tray element 24. Upon detection of the absence of the second lower output tray element 24, the printing device 10 may interrupt printing, for example. Note that any kind of method may be employed without departing from the present invention.

In the embodiment illustrated in FIG. 4A, an operator is enabled to remove the first lower output tray element 12 without immediately causing the printing device 10 to be interrupted, while allowing the operator to transport the stack of output sheets conveniently towards a location where the stack may be easily processed further.

Figure 4B:
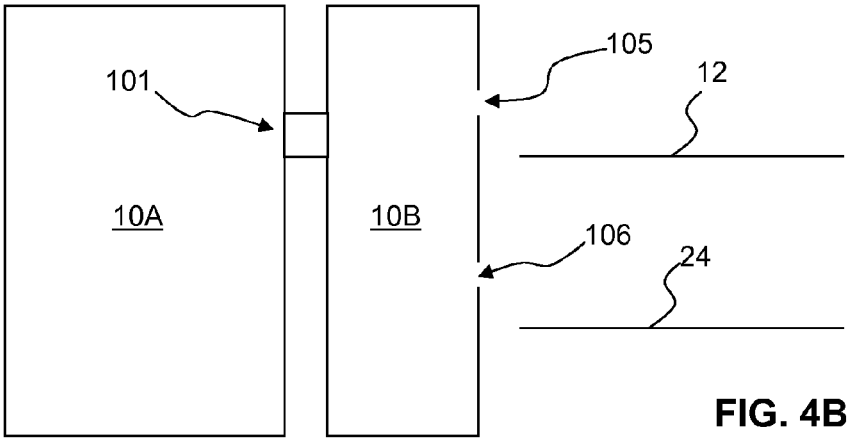

While the present invention has been described and illustrated with reference to an output opening of a printing device 10, it is contemplated that the printing device 10 may be comprised of multiple modules such as a print engine module 10A and an output module 10B and possibly also other modules as shown in FIG. 4B. Moreover, in an embodiment, the print engine module 10A may have a single output opening 101 and may be enabled to be operated stand-alone. The output module 10B may be an optional module for replicating the single output opening 101 into multiple output openings 105, 106. As such it is contemplated that an embodiment of the output assembly according to the present invention is comprised of the output module 10B and two lower output tray elements 12, 24, for example. Hence, the present invention may be embodied in an output assembly comprising a number of mechanically uncoupled modules and elements that are operatively coupled for providing the features and advantages as described and elucidated herein.

Figure 4C:
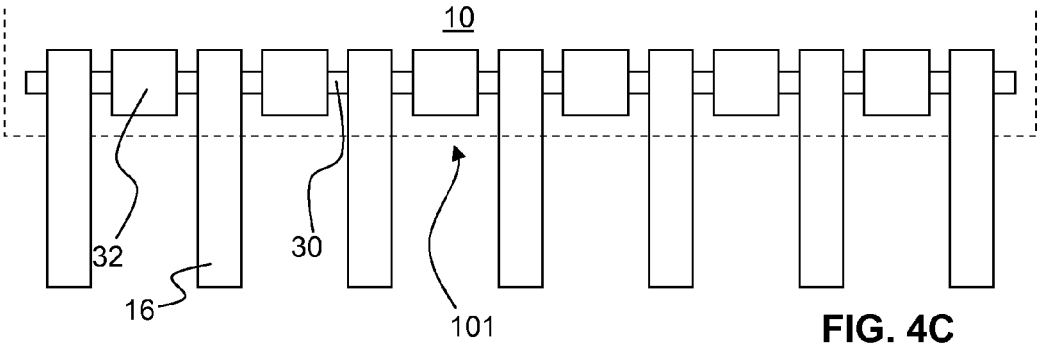
FIG. 4C schematically illustrates a top view of an embodiment of an output assembly in accordance with the present invention.

While the guide element 16 may—in accordance with the present invention—extend over the full width of the output opening 101, FIG. 4C illustrates an embodiment of an output assembly in accordance with the present invention, which embodiment comprises a number of guide elements 16. An outline of the printing device 10 is shown with a dashed line. The output opening 101 is provided with an assembly having an axle 30 with transport rolls 32 arranged thereon. Guide elements 16 are arranged between the transport rolls 32. The transport rolls 32 may be part of a nip in which a sheet is held and transported by turning of the transport rolls 32, as well known in the art. In such embodiment, the transport rolls 32 are arranged to enable transporting a sheet outward up until the trailing edge of the sheet has left the output opening 101. The guide elements 16 are arranged such to reliably guide the sheet being output without disturbing the function of the transport rolls 32.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An output assembly for receiving a sheet of a recording medium from an output opening of a printing device, the printing device being supported on a support surface, the output assembly comprising:

an output tray comprising:

a lower tray element for receiving and supporting the sheet; and a guide element, the guide element being arranged to be moveable in a direction parallel to a direction of movement of the sheet when being output through the output opening, the guide element being positioned below the output opening, wherein the guide element includes:

an extended state for receiving and guiding a leading edge of the sheet; and a retracted state to enable a trailing edge of the sheet to be deposited, wherein the lower tray element is independently supported on the support surface such that the lower tray element is moveable independent and away from the printing device, wherein the sheet has been cut from a roll-fed web of the recording medium, and wherein the output tray further comprises an upper tray element arranged over the lower tray element at a predetermined distance above the lower output tray element, such that a curled leading edge of a sheet is guided from the output opening over the guide element in the extended state under the upper output tray element and then onto the lower output tray element.

2. The output assembly according to claim 1, wherein the lower tray element is slidably supported on the support surface.

3. A printing system comprising:

a printing device; and an output assembly according to claim 1, wherein the printing device is coupled to a sensing unit for determining whether the lower tray element is suitably arranged near the output opening for receiving the sheet.

4. The printing system according to claim 3, wherein the printing device is configured not to output the sheet, if the lower tray element is not suitably arranged for receiving the sheet.

5. The printing system according to claim 4, wherein the printing device comprises a first output opening and a second output opening, wherein the output assembly comprises a first output tray having a first lower tray element and a second output tray having a second lower tray element, wherein the printing device is coupled to a first sensing unit for determining whether the first lower tray is suitably arranged near the first output opening and is coupled to a second sensing unit for determining whether the second lower tray is suitably arranged near the second output opening, and wherein the printing device is configured to select one of the first output opening and the second output opening based on the determination whether the first and the second output tray elements are suitably arranged for receiving the output sheet.

6. The output assembly according to claim 1, wherein the guide element has a length in the direction of movement of the sheet, which length is small compared to a length in the direction of movement of the sheet of the lower tray element, such that the guide element is arranged for:

guiding the leading edge of an output sheet to the lower tray element and depositing such leading edge onto the lower tray element or onto sheets previously deposited on the lower tray element, such that the sheet will slide over the lower tray element or sheets previously deposited on the output tray element without further guidance, and allowing the guide element to be retracted enabling the trailing edge to be deposited onto the lower tray element or onto sheets previously deposited on the output tray element.

7. A method for depositing a sheet through an output opening of a printing device into an output tray of an output assembly, the output assembly further comprising a guide element, a lower tray element for receiving and supporting the sheet, and the upper tray element arranged over the lower tray element at a predetermined distance above the lower output tray element, and the printing device being supported on a support surface, the method comprising:

moving the guide element to extend in a direction parallel to a direction of movement of the sheet when being output through the output opening, the guide element being positioned below the output opening;

feeding the sheet through the output opening, a leading edge of the sheet being guided from the output opening into the output tray, such that a curled leading edge of a sheet is guided from the output opening over the guide element under the upper output tray element and then onto the lower output tray element, retracting the guide element to enable a trailing edge of the sheet to be deposited; and moving the lower tray element independent and away from the printing device, the lower tray element being independently supported on the support surface such that the lower tray element is moveable.

* * * * *